US008427402B2

(12) United States Patent
Smith

(10) Patent No.: US 8,427,402 B2
(45) Date of Patent: Apr. 23, 2013

(54) PASSIVE MATRIX DISPLAY DRIVERS

(75) Inventor: Euan Smith, Longstanton (GB)

(73) Assignee: Cambridge Display Technology Limited, Cambridgeshire (GB)

( * ) Notice: Subject to any disclaimer, the term of this patent is extended or adjusted under 35 U.S.C. 154(b) by 899 days.

(21) Appl. No.: 12/158,920

(22) PCT Filed: Dec. 15, 2006

(86) PCT No.: PCT/GB2006/004698

§ 371 (c)(1),
(2), (4) Date: Aug. 21, 2008

(87) PCT Pub. No.: WO2007/071938

PCT Pub. Date: Jun. 28, 2007

(65) Prior Publication Data

US 2008/0303756 A1 Dec. 11, 2008

(30) Foreign Application Priority Data

Dec. 22, 2005 (GB) ..... 0526064.1

(51) Int. Cl.
*G09G 3/30* (2006.01)

(52) U.S. Cl.
USPC ..... 345/77; 345/76; 345/82; 345/211

(58) Field of Classification Search ..... 345/76, 345/77; 341/126–172
See application file for complete search history.

(56) References Cited

U.S. PATENT DOCUMENTS 4,539,507 A 9/1985 VanSlyke et al.
5,508,716 A 4/1996 Prince et al.
5,751,263 A * 5/1998 Huang et al. ..... 345/82
6,014,119 A 1/2000 Staring et al.
6,201,520 B1 3/2001 Iketsu et al.

(Continued)

FOREIGN PATENT DOCUMENTS

EP 1 079 361 2/2001
EP 1 091 339 4/2001

(Continued)

OTHER PUBLICATIONS

Levy et al., "An 852 × 600 Pixel OLED-on-Silicon Color Microdisplay Using CMOS Subthreshold-Voltage-Scaling Current Drivers," *IEEE Journal of Solid-State Circuits*, 37(12):1879-1889 (2002).

(Continued)

*Primary Examiner* — Amare Mengistu
*Assistant Examiner* — Premal Patel
(74) *Attorney, Agent, or Firm* — Marshall, Gerstein & Borun LLP

(57) ABSTRACT

This invention generally relates to methods and apparatus for driving passive matrix displays, in particular OLED (Organic Light Emitting Diode) displays.

A method of driving a passive matrix electroluminescent display, the display having a plurality of rows and columns of emissive elements addressed by respective row and column electrodes, the method comprising: addressing said row electrodes, one at a time; and driving a set of said column electrodes while addressing each said row electrode; wherein said column electrode driving comprises driving said column electrodes to determine ratios of column drive signals to one another for said set of column electrodes; and wherein the method further comprises controlling an overall drive for said set of column electrodes to control a drive to said emissive elements in each said addressed row.

10 Claims, 11 Drawing Sheets

U.S. PATENT DOCUMENTS

| | | | | |
|---|---|---|---|---|
| 6,332,661 | B1 | 12/2001 | Yamaguchi et al. | |
| 6,975,289 | B1 * | 12/2005 | Beeteson et al. | 345/75.2 |
| 2002/0113808 | A1 * | 8/2002 | Weindorf et al. | 345/699 |
| 2002/0196402 | A1 * | 12/2002 | Sanford et al. | 349/158 |
| 2003/0117354 | A1 * | 6/2003 | Maekawa et al. | 345/87 |
| 2004/0174347 | A1 * | 9/2004 | Sun et al. | 345/204 |
| 2004/0201582 | A1 | 10/2004 | Mizukoshi et al. | |
| 2004/0263087 | A1 * | 12/2004 | Maede et al. | 315/169.3 |
| 2005/0140610 | A1 * | 6/2005 | Smith et al. | 345/77 |
| 2005/0219163 | A1 * | 10/2005 | Smith et al. | 345/76 |
| 2005/0264500 | A1 * | 12/2005 | Shirasaki et al. | 345/77 |

FOREIGN PATENT DOCUMENTS

| | | |
|---|---|---|
| EP | 1 134 719 | 9/2001 |
| EP | 1 450 341 | 8/2004 |
| WO | WO-90/13148 | 11/1990 |
| WO | WO-95/06400 | 3/1995 |
| WO | WO-99/21935 | 5/1999 |
| WO | WO-99/48160 | 9/1999 |
| WO | WO-02/067343 | 8/2002 |
| WO | WO-03/079322 | 9/2003 |
| WO | WO-03/091983 | 11/2003 |
| WO | WO-2006/035246 | 4/2006 |
| WO | WO-2006/035247 | 4/2006 |
| WO | WO-2006/035248 | 4/2006 |

OTHER PUBLICATIONS

Maeda et al., "An Improved Current Driving Method for 256-Level Full Color Active Matrix OLED Displays," *SID 04 Digest*, 35(2):1572-1575 (2004).

International Preliminary Report on Patentability for International Application No. PCT/GB2006/004698, dated Jun. 24, 2008.

International Search Report for PCT/GB2006/004698 dated Feb. 4, 2007.

Search Report for Application No. GB0526064.1, dated Mar. 20, 2006.

Written Opinion for PCT/GB2006/004698 dated Feb. 4, 2007.

* cited by examiner

300

PASSIVE MATRIX DISPLAY DRIVERS

This invention generally relates to methods and apparatus for driving passive matrix displays, in particular OLED (Organic Light Emitting Diode) displays.

Displays such as OLED displays may be characterised as either active matrix or passive matrix displays. Active matrix displays have a memory element, typically a storage capacitor and transistor associated with each pixel whilst passive matrix displays have no such memory element and instead are repetitively scanned to give the impression of a steady image. Passive matrix displays generally comprise a matrix of monochrome or colour pixels addressed by respective row and column electrodes, although other display formats, such as segmented displays, are also possible. In a segmented display a plurality of segments share a common electrode which may be considered to be equivalent to a row (or column) electrode.

It is desirable to be able to provide a greyscale or colour display, that is one in which the brightness of individual pixels (or colour sub-pixels) is variable rather than in a binary state either fully on or fully off.

The conventional method of varying pixel brightness is to vary pixel on-time using Pulse Width Modulation (PWM). In a conventional PWM scheme a pixel is either fully on or fully off, but the apparent brightness of a pixel varies because of integration within the observer's eye. PWM schemes provide a good linear brightness response but OLED lifetime is reduced because for a proportion of the drive period the pixel is fully on, and OLED lifetime reduces, broadly speaking, with the square of the pixel drive (luminance). Another drawback with PWM schemes arises from charging (and discharging) the column capacitance at the leading edge of a drive current waveform, which in some displays can account for up to half the total power consumption.

Consider the example of a 50 percent greyscale pixel. Using a PWM scheme this will be driven at full luminance for half the total available drive time. Ideally one would rather drive the pixel for the full period available, but at half the luminance, which would gain a factor of two in lifetime enhancement, if one assumes a quadratic dependence of lifetime on drive level. However, it is impractical to provide analogue current sources of sufficient number of bits precision to vary column drive current in this way.

The relationship between drive level and pixel luminance is determined by the display gamma, typically around 2.4 for an OLED display. A typical OLED display might require 6 bits of gamma per 2 grey levels which corresponds to 12 bits of linear luminance control. Add to this a further 6 bits of overall brightness control, and this suggests that a driver might need to achieve 18 bits (262144:1) precision of current control for each column driver, of which there may be over 300 on one chip. This is not only technically challenging, but also expensive.

There is therefore a need for improved passive matrix display techniques.

According to the present invention there is therefore provided a method of driving a passive matrix electroluminescent display, the display having a plurality of rows and columns of emissive elements addressed by respective row and column electrodes, the method comprising: addressing said row electrodes, one at a time; and driving a set of said column electrodes whilst addressing each said row electrode; wherein said column electrode driving comprises driving said column electrodes to determine ratios of column drive signals to one another for said set of column electrodes; and wherein the method further comprises controlling an overall drive for said set of column electrodes to control a drive to said emissive elements in each said addressed row.

It will be appreciated that in a passive matrix display it is arbitrary which electrodes are labelled row electrodes and which column electrodes; terms as used here are also intended to cover alternative, equivalent configurations where a variable brightness drive is employed.

Preferably the overall drive for each set of column electrodes is controlled by controlling a drive for each of the addressed row electrodes in turn. However, an alternative scheme may be envisaged in which a fixed drive is applied to each said row electrode in turn and overall control is applied by conventional pulse switch modulation. It will be appreciated that the principles described here are, in theory, applicable to voltage as well as current drive, although, in practice, it is usual to employ a current-control drive to OLEDs because the luminance of an OLED is linearly dependent on the current through it.

Thus in preferred embodiments, a current mirror is used for driving the column electrodes, the current mirror having a reference input and a plurality of outputs, the outputs being coupled to the column electrodes and the reference input being coupled to a selected one of the column electrodes. This provides current ratio control of the drive to the column electrodes. Preferably one or more multiplying digital-to-analogue converters are employed in the current mirror to allow the multiplication (or division) ratio of the column drive signals to be digitally controlled.

The current mirror effectively provides a plurality of current generators ratioed to a reference current generator supplying one of the column electrodes. These current generators may comprise either current sinks or current sources—in other words the current drive to a column may comprise either a positive or negative current. The same is true of the current generator connected to each row electrode in turn, although if a current source is used to drive the column electrodes then a current sink is employed for the selected row electrode, or vice versa.

In embodiments the digital-to-analogue converters used for determining the column drive signal ratios have a lower precision (resolution) than that controlling the overall drive to the addressed row electrode. For example, the column drive ratios may employ 12 bit (4096:1) precision whilst an overall current level determined, for example, by a current sink on the row that is currently being driven, has more accurate control, for example greater than 12, 18 or 24 bits, possibly up to 26 bits. It will be appreciated, however, that only one very accurate (high resolution) current sink (or source) is required as this can be multiplexed so that it is shared by all the rows.

In preferred embodiments the passive matrix display driving system also includes a system for converting colour or monochrome pixel drive level data into a set of ratios and an overall drive, for controlling the column drive/signal ratios and the addressed row current generator. If, for example, the total column drive is used as a reference then each of the other column drive signals can be expressed as a fraction of this highest drive and the highest drive becomes the overall drive for the set of columns.

These techniques may be applied to a subset of the columns of a display or, in embodiments, to all the display columns.

Preferably the display comprises a monochrome or colour OLED display. However, the above-described techniques may also be employed with other types of electroluminescent display including, but not limited to an inorganic LED display, a Vacuum Fluorescent Display (VFD), a plasma display such as PDP (Plasma Display Panel), and thick and thin (TFEL) film electroluminescent displays such as an iFire (®) display.

The invention further provides a passive matrix electroluminescent display driver for driving a display having a plurality of rows and columns of emissive elements addressed by respective row and column electrodes, the display driver comprising:

means for addressing said row electrodes, one at a time; means for driving a set of said column electrodes whilst addressing each said row electrode; means for ratioing said drive signals for said column electrodes to one another; and means for controlling an overall drive level for said set of column electrodes.

In a further aspect the invention provides a driver for a passive matrix electroluminescent display, the display having a plurality of rows and columns of emissive elements addressed by respective rows and column electrodes, the driver comprising: a column driver for driving a set of column electrodes in accordance with a set of column electrode drive ratios; and a row driver for selecting one of said row electrodes; and a system for controlling overall drive for said set of column electrodes.

A digital data input may be provided for determining the column electrode drive ratios, and for the overall drive. Preferably, as previously mentioned, the column driver and the row driver each comprise a programmable current generator such as a current source or sink. Preferably the current generator of the row driver is controllable with a greater accuracy or precision than the current drive system for the column electrodes which determines the column electrode drive ratios, for example using a plurality of digital-to-analogue converters in the column driver and one higher resolution digital-to-analogue converter in the row driver. Preferably the system also includes a data processor to convert incoming drive level data to column drive ratio data and overall drive level data. The data processor may comprise dedicated hardware, for example as part of a driver integrated circuit, or a programmable processor operating under the control of stored processor control code.

These and other aspects of the invention will now be further described, by way of example only, with reference to the accompanying figures in which:

FIGS. 1*a* and 1*b* show, respectively, a vertical cross section through an OLED device, and a simplified cross section through a passive matrix OLED display;

Figure 5A:
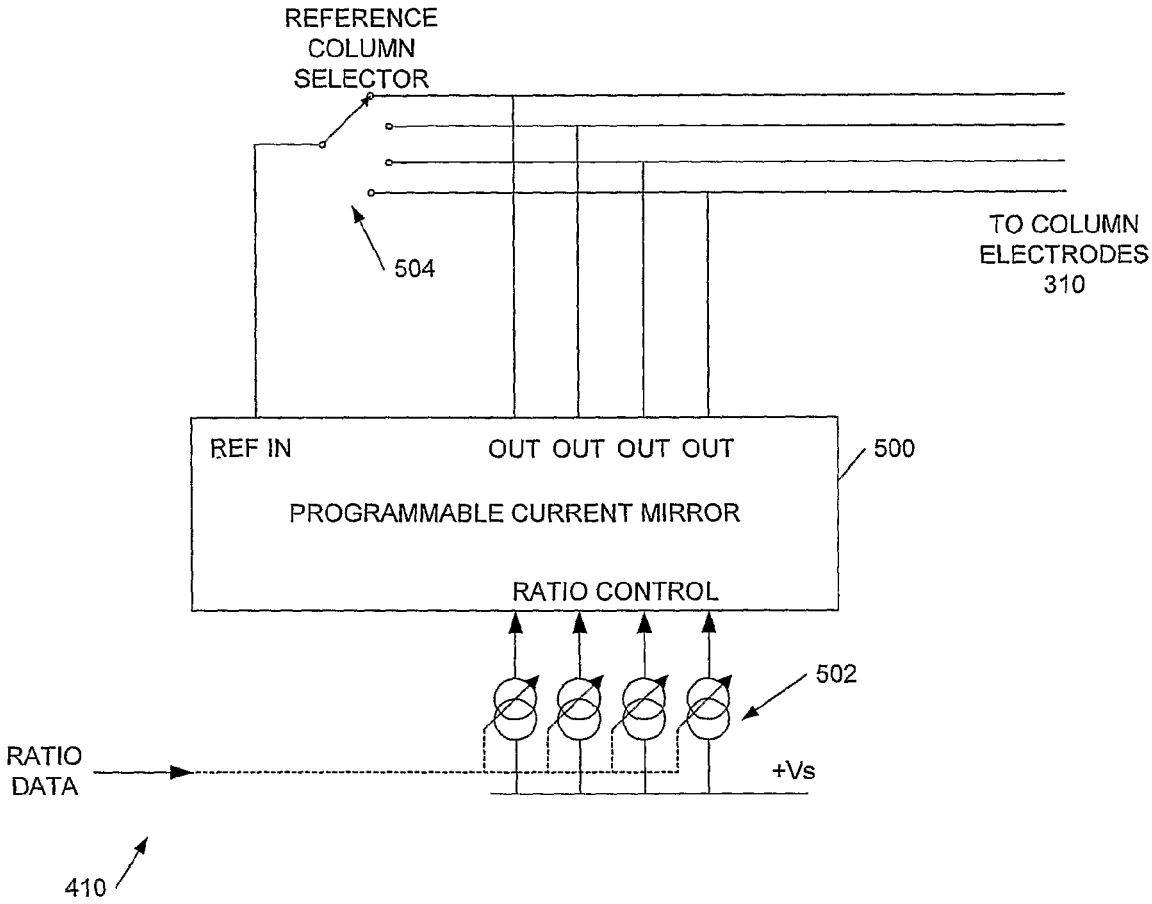
Figure 5B:
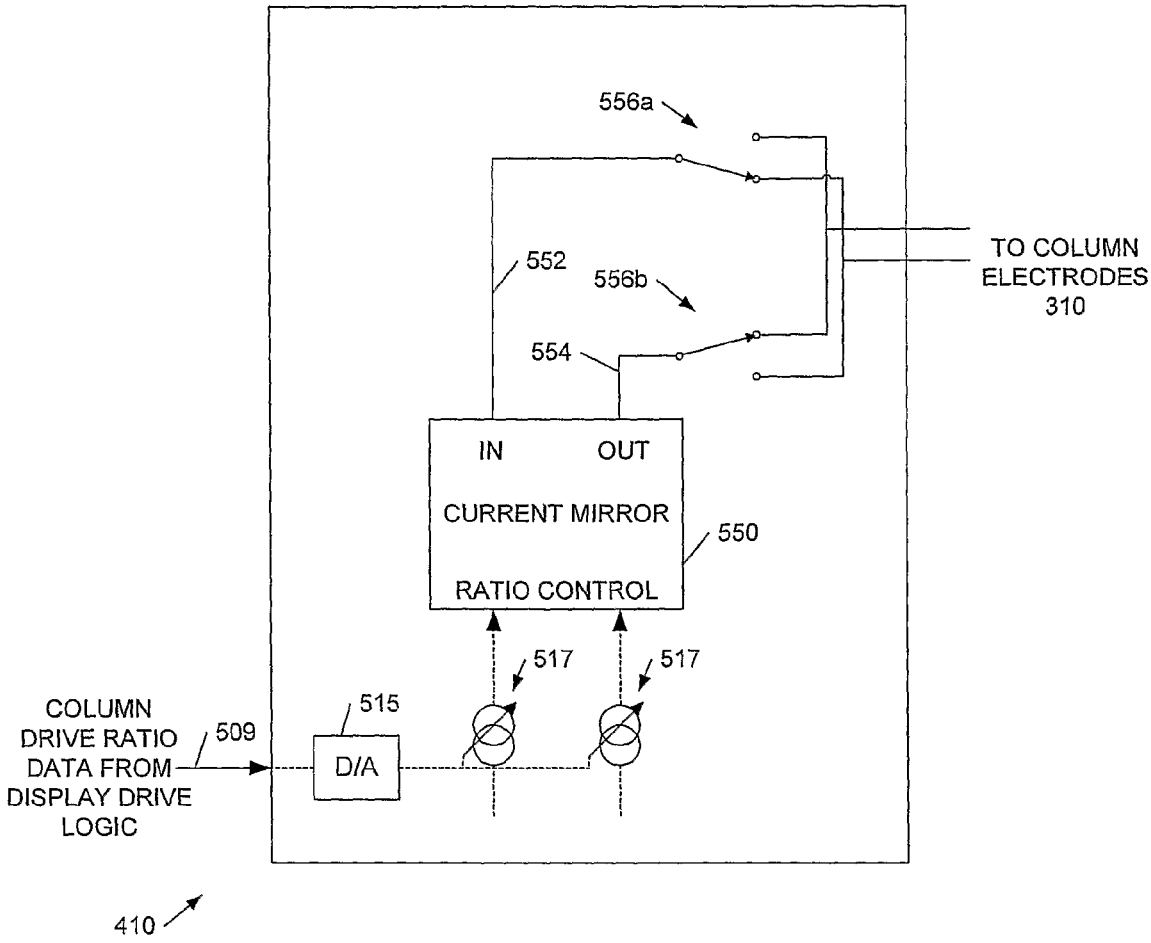
Figure 5C:
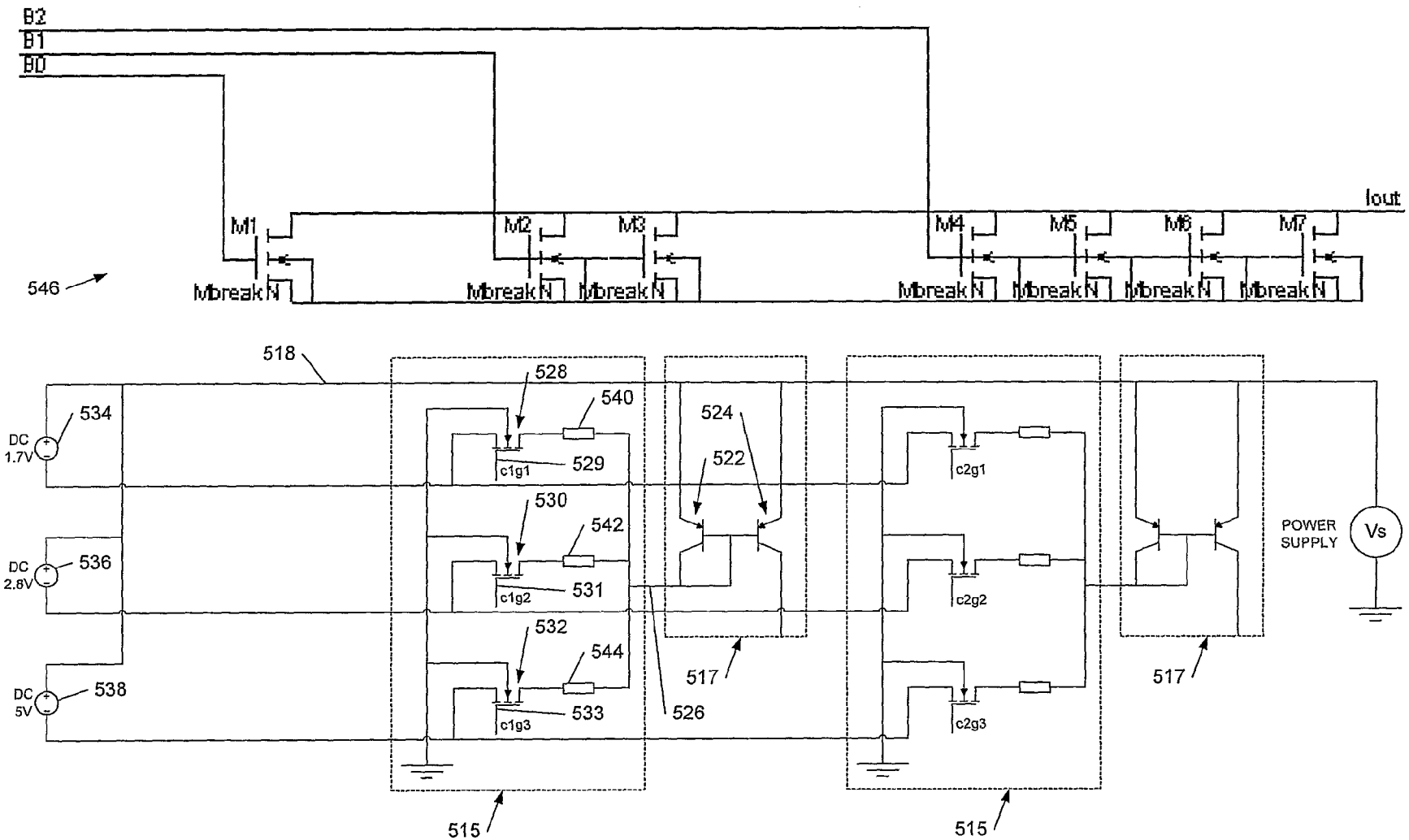
Figure 5D:
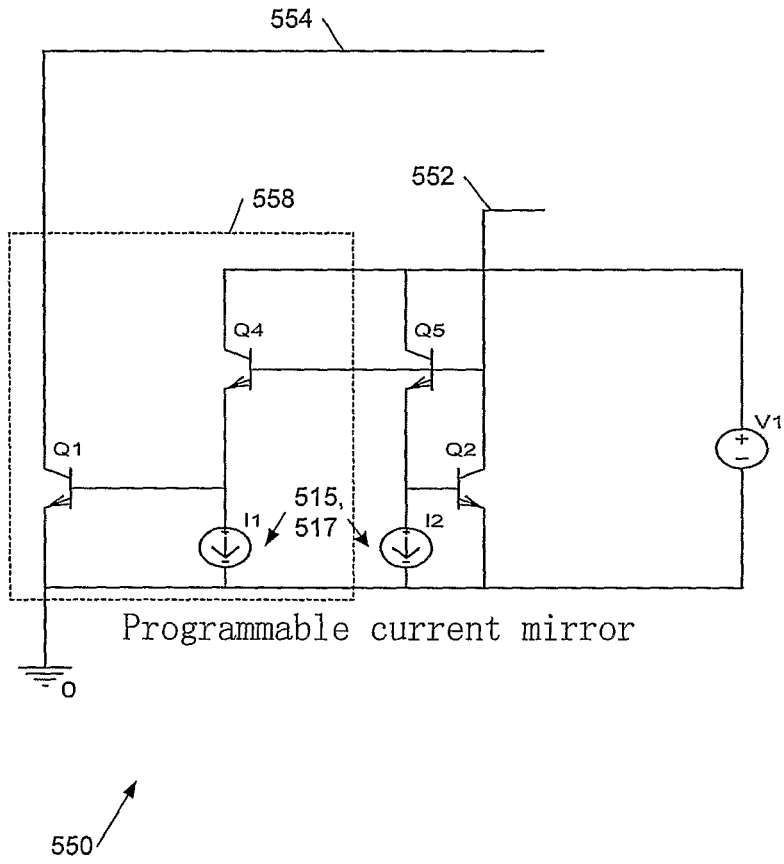
Figure 5E:
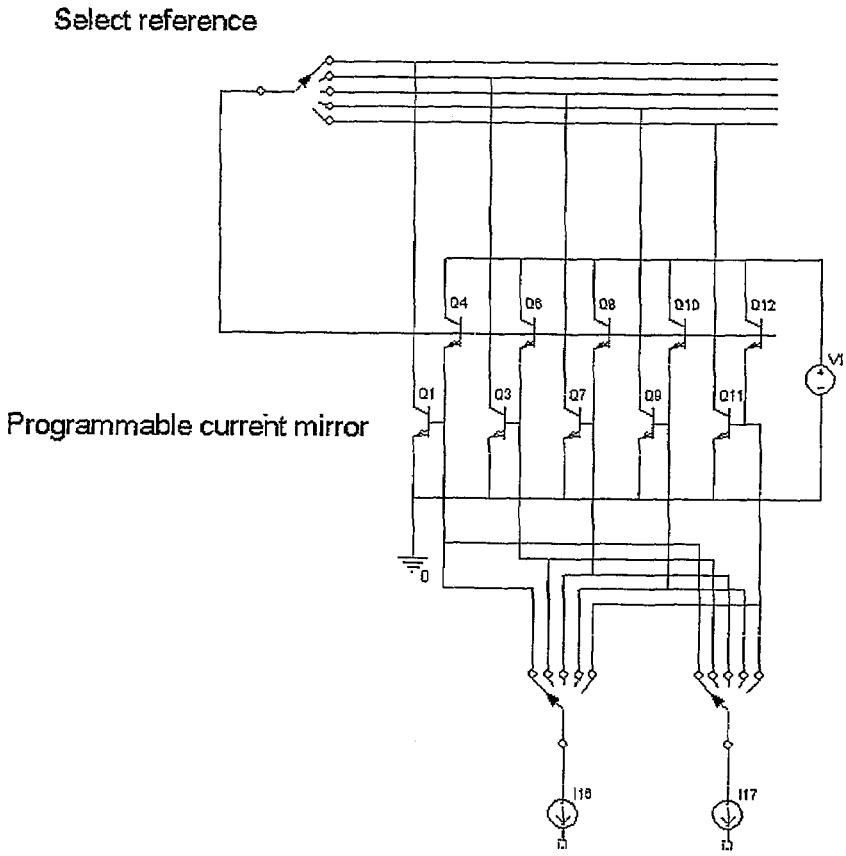
Figure 5F:
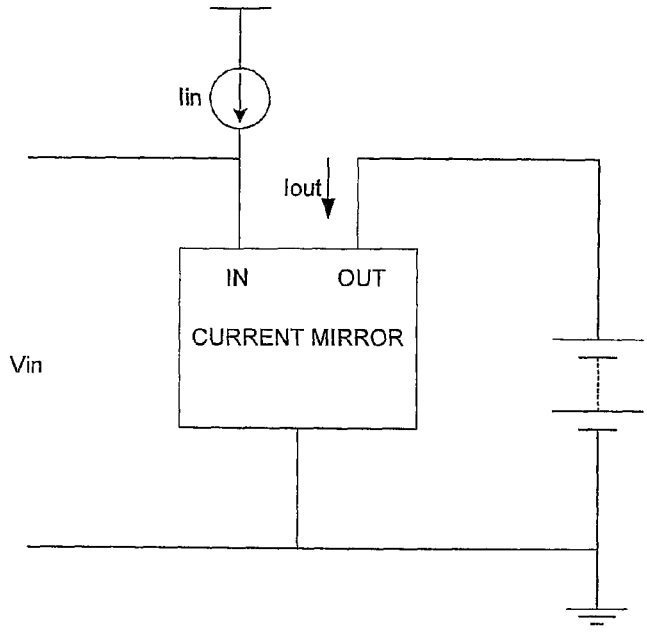
Figure 5f (PRIOR ART)
Figure 5G:
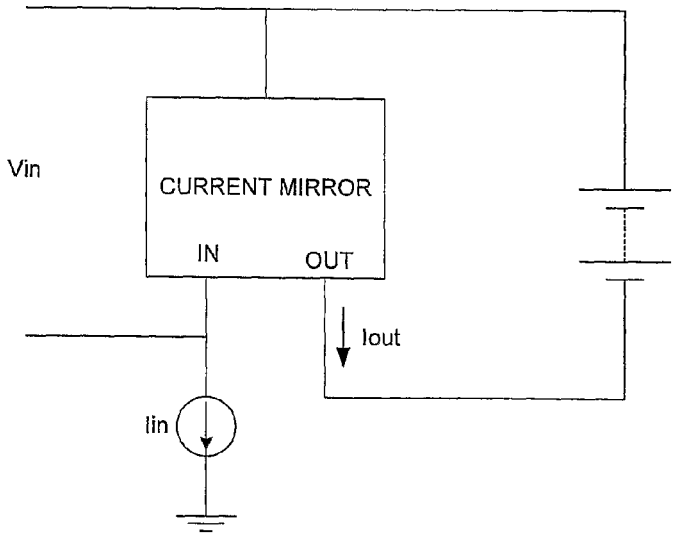
Figure 5g (PRIOR ART)
Figure 6:
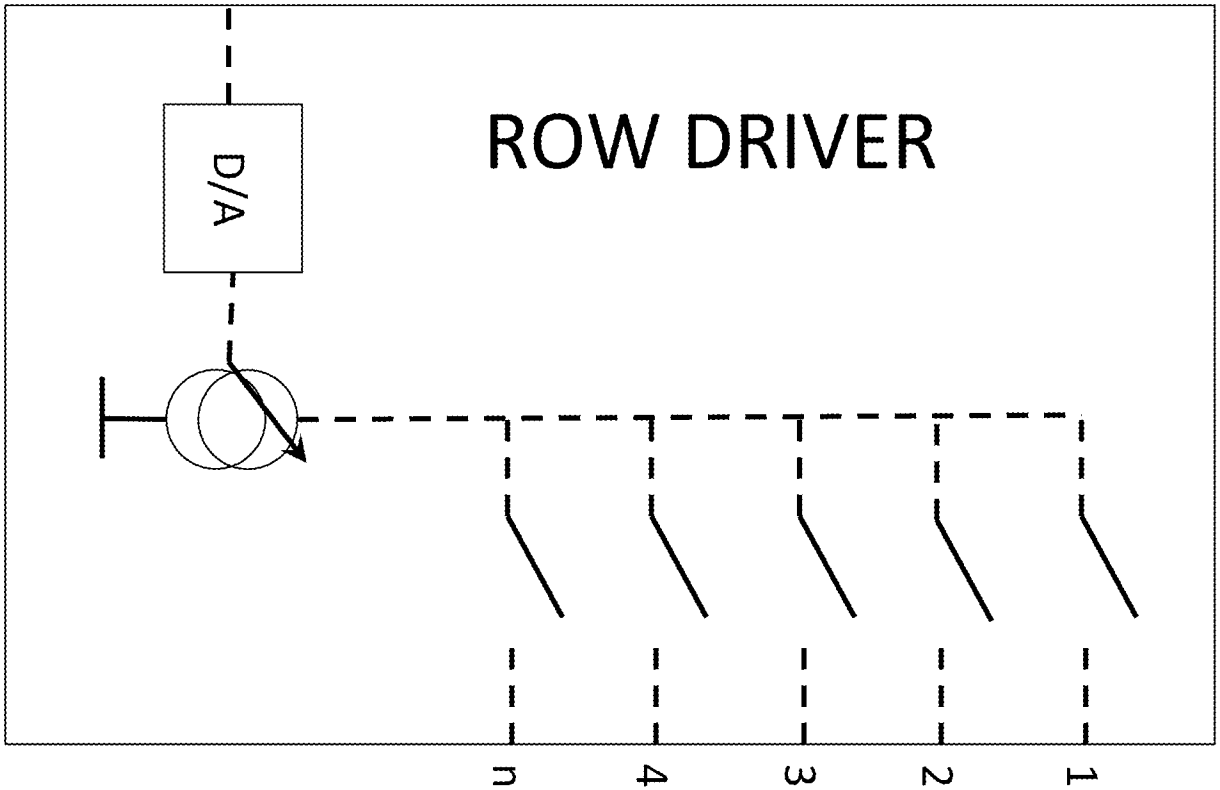

FIGS. 5*a* to 5*g* show, respectively, an example column driver illustrating ratioed column current drive, a further example column driver, example implementations of a controllable current source, an example programmable current mirror, a second example programmable current mirror, and first and second block diagrams of current mirrors according to the prior art; and FIG. 6 shows an example row driver 412 that includes a digital-to-analog converter to digitally control a current sink, for example, the digitally controllable current generator 412*a*.

Organic Light Emitting Diode Displays

Organic light emitting diodes, which here include organometallic LEDs, may be fabricated using materials including polymers, small molecules and dendrimers, in a range of colours which depend upon the materials employed. Examples of polymer-based organic LEDs are described in WO 90/13148, WO 95/06400 and WO 99/48160; examples of dendrimer-based materials are described in WO 99/21935 and WO 02/067343; and examples of so called small molecule based devices are described in U.S. Pat. No. 4,539,507. A typical OLED device comprises two layers of organic material, one of which is a layer of light emitting material such as a light emitting polymer (LEP), oligomer or a light emitting low molecular weight material, and the other of which is a layer of a hole transporting material such as a polythiophene derivative or a polyaniline derivative.

Organic LEDs may be deposited on a substrate in a matrix of pixels to form a single or multi-colour pixellated display. A multicoloured display may be constructed using groups of red, green, and blue emitting sub-pixels. So-called active matrix displays have a memory element, typically a storage capacitor and a transistor, associated with each pixel whilst passive matrix displays have no such memory element and instead are repetitively scanned to give the impression of a steady image. Other passive displays include segmented displays in which a plurality of segments share a common electrode and a segment may be lit up by applying a voltage to its other electrode. A simple segmented display need not be scanned but in a display comprising a plurality of segmented regions the electrodes may be multiplexed (to reduce their number) and then scanned.

Figure 1A:
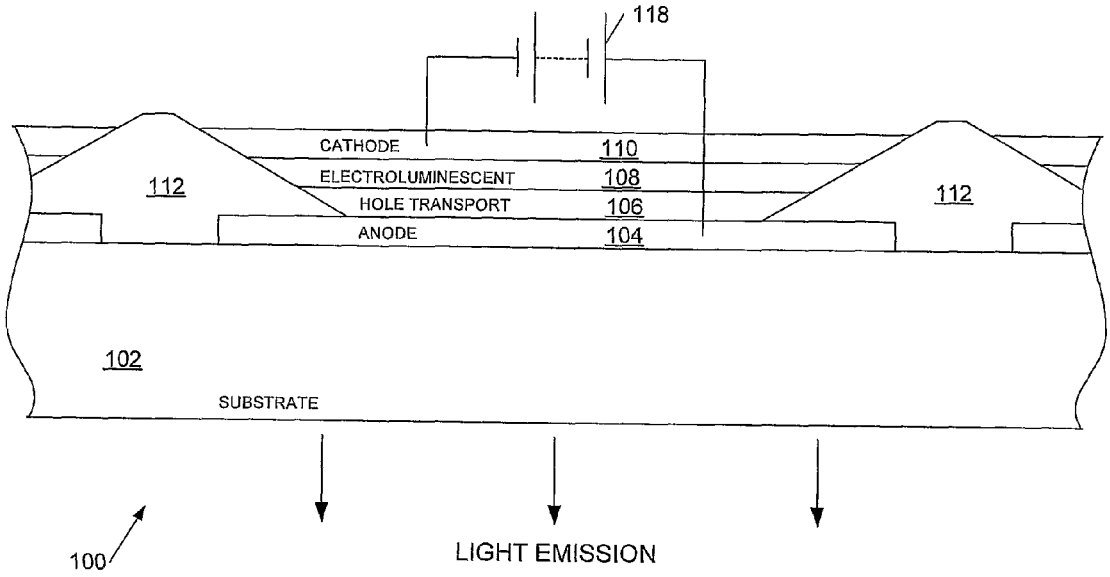
Figure 1a (PRIOR ART)

FIG. 1*a* shows a vertical cross section through an example of an OLED device 100. In an active matrix display part of the area of a pixel is occupied by associated drive circuitry (not shown in FIG. 1*a*). The structure of the device is somewhat simplified for the purposes of illustration.

The OLED 100 comprises a substrate 102, typically 0.7 mm or 1.1 mm glass but optionally clear plastic or some other substantially transparent material. An anode layer 104 is deposited on the substrate, typically comprising around 150 nm thickness of ITO (indium tin oxide), over part of which is provided a metal contact layer. Typically the contact layer comprises around 500 nm of aluminium, or a layer of aluminium sandwiched between layers of chrome, and this is sometimes referred to as anode metal. Glass substrates coated with ITO and contact metal are available from Corning, USA. The contact metal over the ITO helps provide reduced resistance pathways where the anode connections do not need to be transparent, in particular for external contacts to the device. The contact metal is removed from the ITO where it is not wanted, in particular where it would otherwise obscure the display, by a standard process of photolithography followed by etching.

A substantially transparent hole transport layer 106 is deposited over the anode layer, followed by an electroluminescent layer 108, and a cathode 110. The electroluminescent layer 108 may comprise, for example, a PPV (poly(p-phenylenevinylene)) and the hole transport layer 106, which helps match the hole energy levels of the anode layer 104 and electroluminescent layer 108, may comprise a conductive transparent polymer, for example PEDOT:PSS (polystyrene-sulphonate-doped polyethylene-dioxythiophene) from Bayer AG of Germany. In a typical polymer-based device the hole transport layer 106 may comprise around 200 nm of PEDOT; a light emitting polymer layer 108 is typically around 70 nm in thickness.

These organic layers may be deposited by spin coating (afterwards removing material from unwanted areas by plasma etching or laser ablation) or by inkjet printing. In this latter case banks 112 may be formed on the substrate, for example using photoresist, to define wells into which the organic layers may be deposited. Such wells define light emitting areas or pixels of the display.

Cathode layer 110 typically comprises a low work function metal such as calcium or barium (for example deposited by physical vapour deposition) covered with a thicker, capping layer of aluminium. Optionally an additional layer may be provided immediately adjacent the electroluminescent layer, such as a layer of barium fluoride, for improved electron energy level matching. Mutual electrical isolation of cathode lines may be achieved or enhanced through the use of cathode separators (not shown in FIG. 1*a*).

The same basic structure may also be employed for small molecule and dendrimer devices. Typically a number of displays are fabricated on a single substrate and at the end of the fabrication process the substrate is scribed, and the displays separated before an encapsulating can is attached to each to inhibit oxidation and moisture ingress.

To illuminate the OLED power is applied between the anode and cathode, represented in FIG. 1*a* by battery 118. In the example shown in FIG. 1*a* light is emitted through transparent anode 104 and substrate 102 and the cathode is generally reflective; such devices are referred to as "bottom emitters". Devices which emit through the cathode ("top emitters") may also be constructed, for example by keeping the thickness of cathode layer 110 less than around 50-100 nm so that the cathode is substantially transparent.

It will be appreciated that the foregoing description is merely illustrative of one type of OLED display, to assist in understanding some applications of embodiments of the invention. There are a variety of other types of OLED, including reverse devices where the cathode is on the bottom such as those produced by Novaled GmbH. Moreover application of embodiments of the invention are not limited to displays, OLED or otherwise.

Organic LEDs may be deposited on a substrate in a matrix of pixels to form a single or multi-colour pixellated display. A multicoloured display may be constructed using groups of red, green, and blue emitting sub-pixels. In such displays the individual elements are generally addressed by activating row (or column) lines to select the sub-pixels.

Figure 1B:
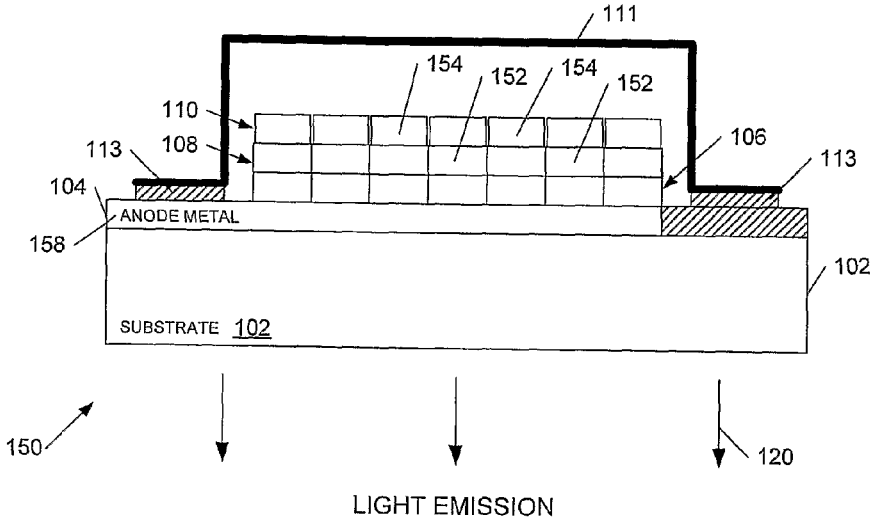
Figure 1b (PRIOR ART)

Referring now to FIG. 1*b*, this shows a simplified cross-section through a passive matrix OLED display device 150, in which like elements to those of FIG. 1*a* are indicated by like reference numerals. As shown the hole transport 106 and electroluminescent 108 layers are subdivided into a plurality of pixels 152 at the intersection of mutually perpendicular anode and cathode lines defined in the anode metal 104 and cathode layer 110 respectively. In the figure conductive lines 154 defined in the cathode layer 110 run into the page and a cross-section through one of a plurality of anode lines 158 running at right angles to the cathode lines is shown. An electroluminescent pixel 152 at the intersection of a cathode and anode line may be addressed by applying a voltage between the relevant lines. The anode metal layer 104 provides external contacts to the display 150 and may be used for both anode and cathode connections to the OLEDs (by running the cathode layer pattern over anode metal lead-outs). The above mentioned OLED materials, in particular the light emitting polymer and the cathode, are susceptible to oxidation and to moisture and the device is therefore encapsulated in a metal can 111, attached by UV-curable epoxy glue 113 onto anode metal layer 104, small glass beads within the glue preventing the metal can touching and shorting out the contacts.

Figure 2:
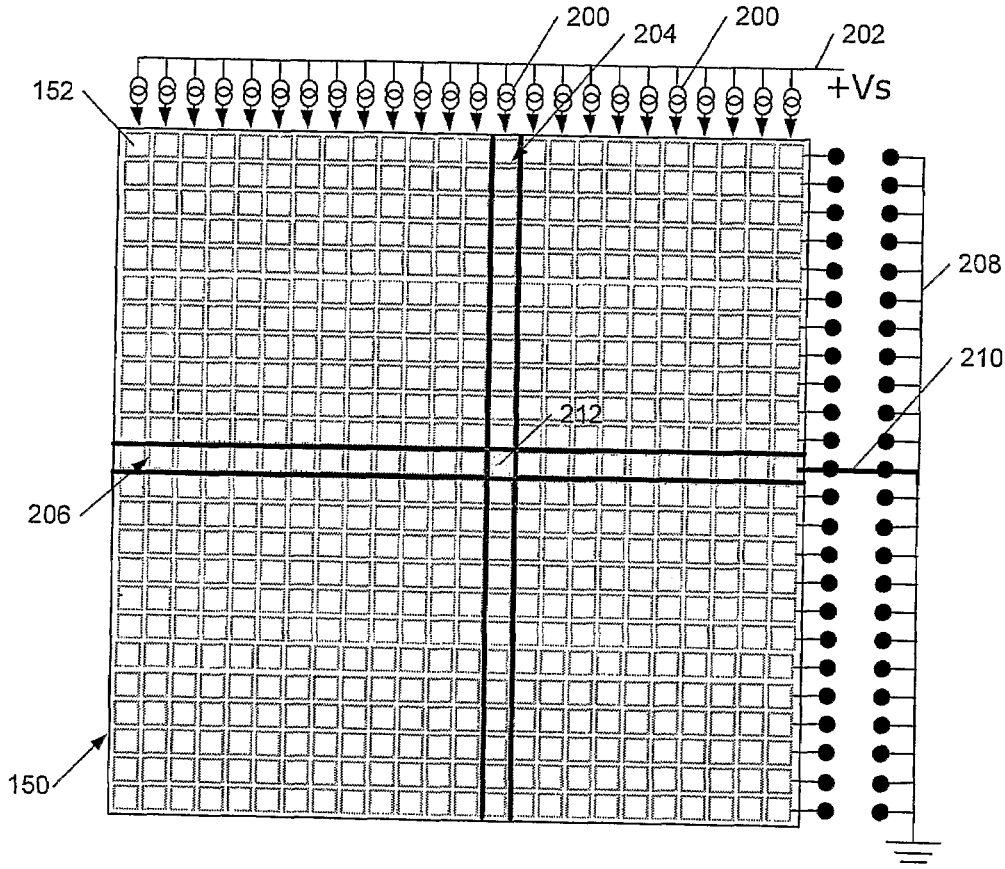
FIG. 2 shows conceptually a driving arrangement for a passive matrix OLED display.

Referring now to FIG. 2, this shows, conceptually, a driving arrangement for a passive matrix OLED display 150 of the type shown in FIG. 1*b*. A plurality of constant current generators 200 are provided, each connected to a supply line 202 and to one of a plurality of column lines 204, of which for clarity only one is shown. A plurality of row lines 206 (of which only one is shown) is also provided and each of these may be selectively connected to a ground line 208 by a switched connection 210. As shown, with a positive supply voltage on line 202, column lines 204 comprise anode connections 158 and row lines 206 comprise cathode connections 154, although the connections would be reversed if the power supply line 202 was negative and with respect to ground line 208.

As illustrated pixel 212 of the display has power applied to it and is therefore illuminated. Conceptually, to create an image a row is selected by connection 210 and all the columns written in parallel, that is a current driven onto each of the column lines simultaneously to illuminate each pixel in a row at its desired brightness.

The skilled person will appreciate that in a passive matrix OLED display it is arbitrary which electrodes are labelled row electrodes and which column electrodes, and in this specification "row" and "column are used interchangeably.

Figure 3:
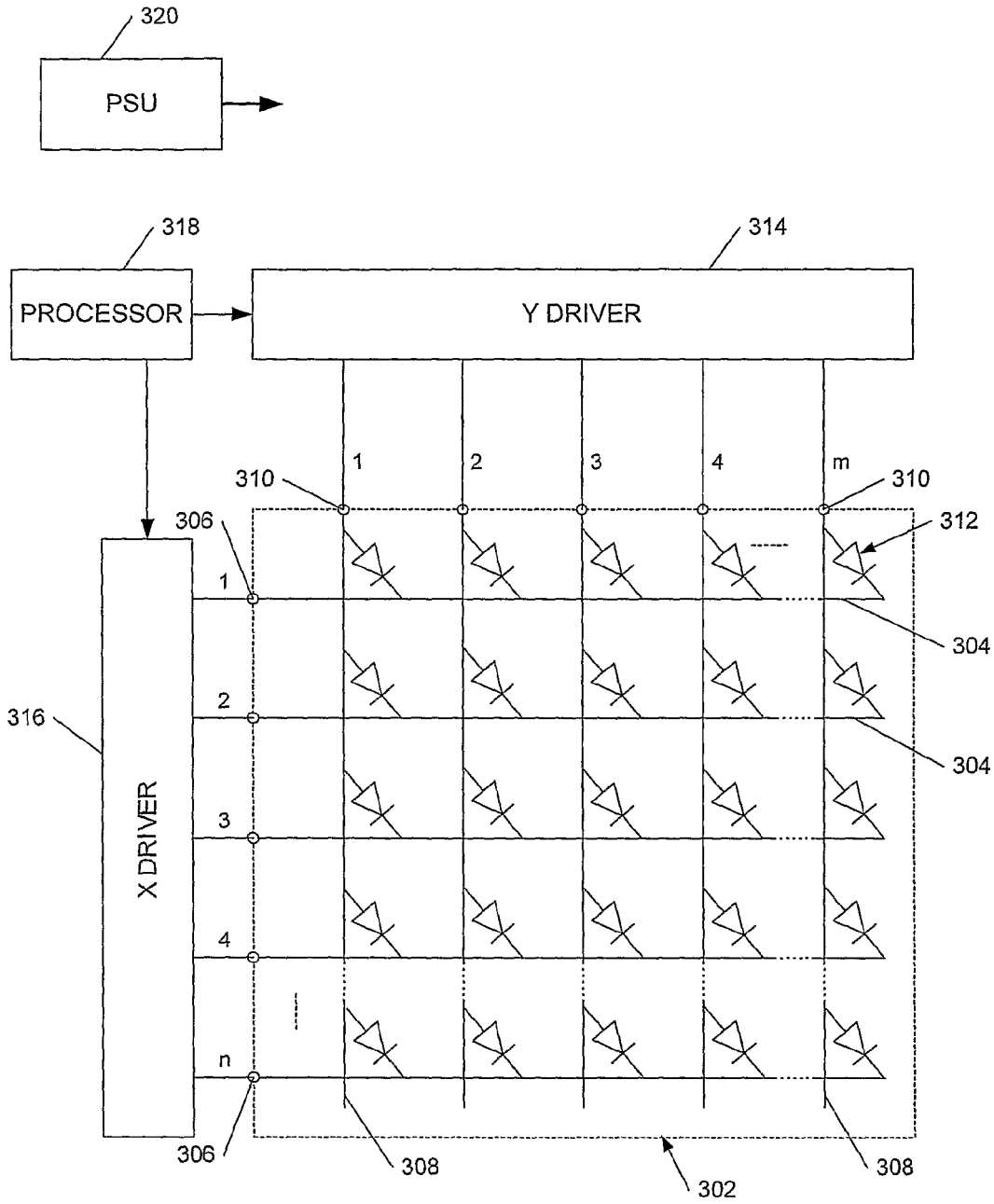
Figure 3 (PRIOR ART)
FIG. 3 shows a block diagram of a known passive matrix OLED display driver.

FIG. 3 shows a schematic diagram 300 of a generic driver circuit for a passive matrix OLED display according to the prior art. The OLED display is indicated by dashed line 302 and comprises a plurality n of row lines 304 each with a corresponding row electrode contact 306 and a plurality m of column lines 308 with a corresponding plurality of column electrode contacts 310. An OLED is connected between each pair of row and column lines with, in the illustrated arrangement, its anode connected to the column line. A y-driver 314 drives the column lines 308 with a constant current and an x-driver 316 drives the row lines 304, selectively connecting the row lines to ground. The y-driver 314 and x-driver 316 are typically both under the control of a processor 318. A power supply 320 provides power to the circuitry and, in particular, to y-driver 314.

Some examples of OLED display drivers are described in U.S. Pat. No. 6,014,119, U.S. Pat. No. 6,201,520, U.S. Pat. No. 6,332,661, EP 1,079,361A and EP 1,091,339A and OLED display driver integrated circuits employing PWM are sold by Clare Micronix of Clare, Inc., Beverly, Mass., USA. Some examples of improved OLED display drivers are described in the Applicant's co-pending applications WO 03/079322 and WO 03/091983. In particular WO 03/079322, hereby incorporated by reference, describes a digitally controllable programmable current generator with improved compliance.

Improved Display Driving Techniques

There is a continuing need for techniques which can improve the lifetime of an OLED display. There is a particular need for techniques which are applicable to passive matrix displays since these are very much cheaper to fabricate than active matrix displays. Reducing the drive level (and hence brightness) of an OLED can significantly enhance the lifetime of the device—for example halving the drive/brightness of the OLED can increase its lifetime by approximately a factor of four. We here describe techniques which can be employed to reduce peak display drive levels, in particular in passive matrix OLED displays, and hence increase display lifetime.

Figure 4:
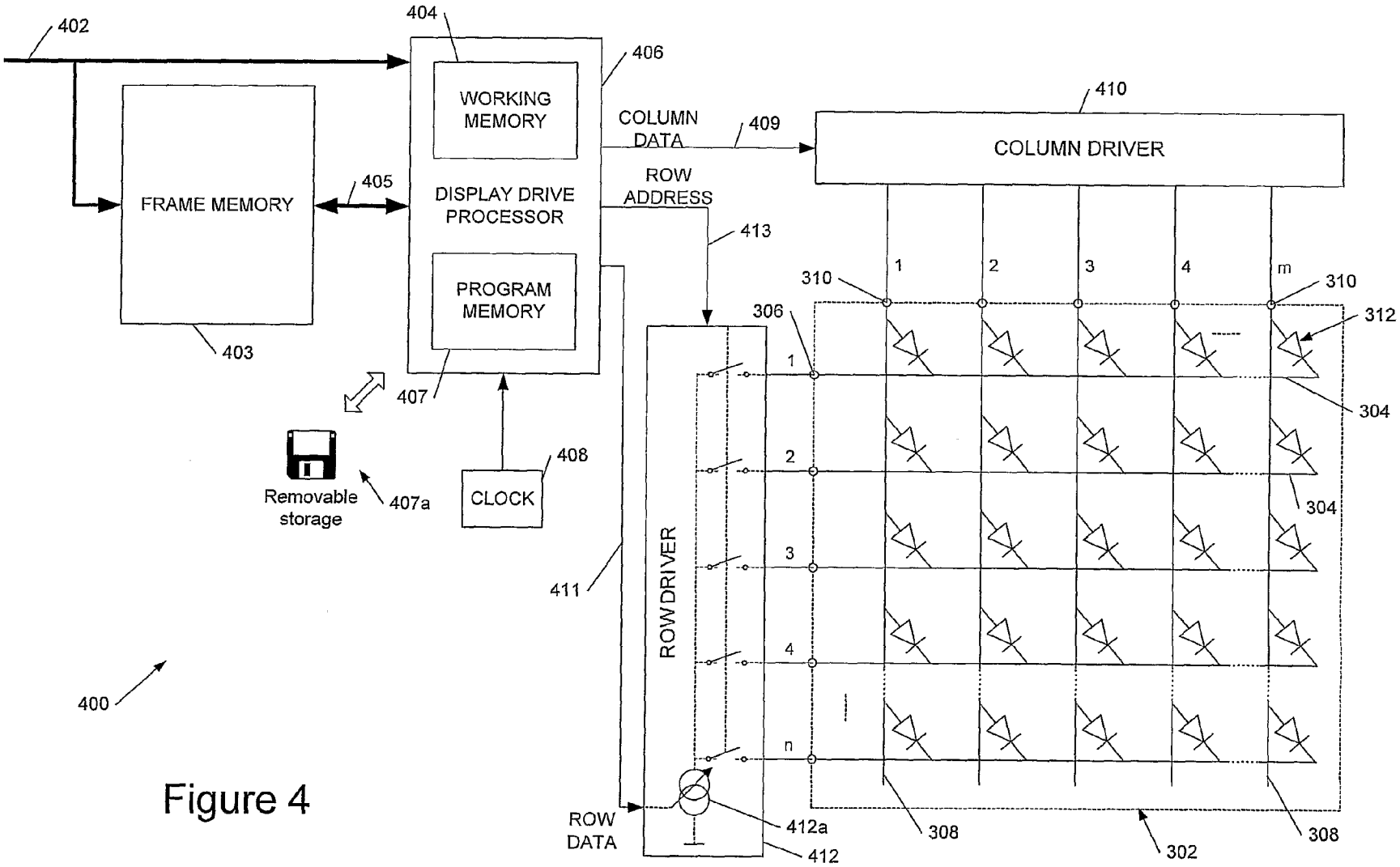
FIG. 4 shows a display driver embodying an aspect of the present invention.

FIG. 4 shows a schematic diagram of a passive matrix OLED driver 400 which implements a drive scheme according to an embodiment of the invention.

In FIG. 4 a passive matrix OLED display similar to that described with reference to FIG. 3 has row electrodes 306 driven by row driver circuits 412 and column electrodes 310 driven by column driver 410. Column driver 410 has a column data input 409 for setting a set of current drive ratios for the column electrodes. Details of the column driver are described below with reference to FIG. 5. Row driver 412 has a row address input 413 for selecting a row, and a row data input 411 for setting the overall current drive for the selected row, that is in effect the total current drive for the set of columns driven by column driver 410 onto the selected row. Preferably inputs 409, 411 and 413 are digital inputs for ease of interfacing. Thus row driver incorporates a digitally controllable current generator 412*a*, a current sink in this example. An example of such a digitally controllable current generator is shown in FIG. 5*c*.

Data for display is provided on a data and control bus 402, which may be either serial or parallel. Bus 402 provides an input to a frame store memory 403 which stores luminance data for each pixel of the display or, in a colour display, luminance information for each sub-pixel (which may be encoded as separate RGB colour signals or as luminance and chrominance signals or in some other way). The data stored in frame memory 403 determines a desired apparent brightness for each pixel (or sub-pixel) for the display, and this information may be read out by means of a second, read bus 405 by a display drive processor 406 (in embodiments bus 405 may be omitted and bus 402 used instead).

Display drive processor 406 may be implemented in hardware, software or in a combination of the two. As shown processor 406 is implemented by means of code (which may be provided on a data carrier or removable storage 407*a*) stored in a program memory 407, operating under control of a clock 408 and in conjunction with working memory 404. The code in program memory 407 is configured to convert luminance data for each pixel of the display into column drive ratio data and corresponding overall row drive data.

FIG. 5*a* shows an example column driver 410, illustrating the principle of the ratioed column drive. Thus ratio data is provided to a set of constant generators 502, preferably digitally programmable, which set drive current ratios for a programmable current mirror 500 which connects to column electrodes 310. A reference row selector, here shown schematically as a multi-pole switch 504, selectively connects one of the column electrodes to the (reference) input of current mirror 500.

We have described examples of suitable programmable current mirror circuits in the Applicant's PCT application GB2005/050168 filed on 29 Sep. 2005 (claiming priority from UK patent application no. 0421711.3 filed on 30 Sep. 2004), hereby incorporated by reference in its entirety.

Broadly speaking this PCT application describes a current generator for an electroluminescent display driver, the current generator comprising: a first, reference current input to receive a reference current; a second, ratioed current input to receive a ratioed current; a first ratio control input to receive a first control signal input; a controllable current mirror having a control input coupled to the first ratio control input, a current input coupled to the reference current input, and an output coupled to the ratioed current input; the current generator being configured such that a signal on the control input controls a ratio of the ratioed current to the reference current. (It will be recalled that a current input may comprise either a positive or negative current).

Preferably this current generator also includes a second ratio control input, the ratio of signals at the first and second ratio control inputs determining a ratio of currents flowing into the first and second current inputs. The first and second control signals may comprise current signals, and the current generator may include one or more digital-to-analogue converters to provide these current signals. Such an analogue-to-digital converter may comprise a plurality of MOS switches, one for each bit, each switching a respective power supply to a corresponding current setting resistor (or the transistor itself may limit the current).

As shown in FIG. 5*a*, in embodiments the current generator also includes a selector or multiplexer to selectively connect one of a plurality of electrode drive connections to the reference current input and one or more other of the electrode drive connections to the second, ratioed current input. Where more than two electrodes are driven together the current generator may have a plurality of the second, ratioed current connections, each of which may be selectively coupled to a drive connection.

Alternatively the current mirror may have a plurality of connections each hardwired to an electrode drive connection to provide a corresponding second, ratioed current, the one or more ratio control inputs then being selectively coupled to one or more control signals or controllable current generators (a selector or multiplexer is then employed to selectively connect the reference current input to an electrode drive connection). The electrode connection carrying the largest current is preferably (but not necessarily) selected as the reference.

In some preferred embodiments the current mirror comprises a plurality of mirror units each comprising a transistor, for example a bipolar transistor, one for each of the selectable plurality of electrode drive connections; a mirror unit coupled to the reference current input may comprise a transistor with a beta helper.

The PCT application also describes a current driver circuit for driving a plurality of electrodes of an electroluminescent display, the driver circuit comprising: a control input to receive a control signal; a plurality of drive connections for the plurality of display electrodes; a selector configured to select one of the plurality of drive connections as a first connection and at least one other of the drive connections as a second connection; and a driver configured to provide respective first and second drive signals for the first and second connections, a ratio of the first and second drive signals being controlled in accordance with the control signal.

Thus referring now to FIG. 5*b*, this further illustrates an example column driver 410.

The column driver 410 shown incorporates two digitally controllable current sources 517, each under control of respective digital-to-analogue converter 515. In this embodiment one digitally controllable current source is provided for each column electrode driven. These may be implemented, for example, using the arrangement of FIG. 5*c*, below.

The controllable current sources 517 may be programmed to source currents in a desired ratio (or ratios) corresponding to a ratio (or ratios) of column drive levels. Controllable current sources 517 are thus coupled to a ratio control current mirror 550 which has an input 552 for receiving a first (negative) referenced current and one or more outputs 554 for sourcing one or more output currents, the ratio of an output current to the input current being determined by a ratio of control inputs defined by controllable current generators 517 in accordance with column data on line 409.

FIGS. 5*f* and 5*g* illustrate current mirror configurations according to the prior art with, respectively, a ground reference and a positive supply reference, showing the sense of the input and output currents. It can be seen that these currents are both in the same sense but may be either positive or negative.

In the example of FIG. 5*b* two column electrode selectors/multiplexers 556*a, b* are provided to allow selection of one column electrode to provide a reference current and another column electrode to provide an output current; optionally further multiplexers 556*b* and outputs from mirror 550 may be provided.

As illustrated column driver 410 allows the selection of two columns for concurrent driving but in practice alternative arrangements may be employed—for example a set of columns may be divided into blocks each with a ratioed column current driver (for example, for twelve columns using one reference and eleven mirrors), or a single ratioed column current driver may be provided for all the columns of a display.

Details of example implementations of controllable current sources are shown in FIG. 5*c*.

In the lower circuit example it can be seen that a controllable current source 517 comprises a pair of transistors 522, 524 connected to a power line 518 in a current mirror configuration. Since, in this example, the column driver comprises current sources these are PNP bipolar transistors connected to a positive supply line; to provide a current sink NPN transistors connected to ground are employed; in other arrangements MOS transistors may be used.

The digital-to-analogue converters 515 each comprise a plurality of FET switches 528, 530, 532 (in this instance three switches), each connected to a respective power supply 534, 536, 538. The gate connections 529,531, 533 provide a digital input switching the respective power supply to a corresponding current set resistor 540, 542, 544, each resistor being connected to a current input 526 of a current mirror 517. The power supplies have voltages scaled in powers of two, that is each twice that of the next lowest power supply less a $V_{gs}$ drop so that a digital value on the FET gate connections is converted into a corresponding current on a line 526; alternatively the power supplies may have the same voltage and the resistors 540, 542, 544 may be scaled.

The upper circuit in FIG. 5*c* shows an alternative D/A controlled current source/sink 546, with a binary data input B0, B1, B2 controlling respectively one, two and four similarly-sized MOS transistors. Alternatively where multiple transistors are shown a single appropriately-sized larger transistor may be employed instead.

The controllable current sink 412*a* of FIG. 4 may be implemented in a similar way to that shown in FIG. 5*c*, but employing a current sink rather than a current source mirror.

FIG. 5*d* shows details of an example programmable ratio control current mirror 550, shown as a current sink although the skilled person will recognise that the circuit may easily be modified to provide a current source.

In this example implementation a bipolar current mirror with a so-called beta helper (Q5) is employed, but the skilled person will recognise that many other types of current mirror circuit may also be used. In the circuit of FIG. 5*d* V1 is a power supply of typically around 3V and I1 and I2 define the ratio of currents in the collectors of Q1 and Q2. The currents in the two lines 552, 554 are in the ratio I1 to I2 and thus a given total column current is divided between the two selected columns in this ratio. The skilled person will appreciate that this circuit can be extended to an arbitrary number of mirrored columns by providing a repeated implementation of the circuitry within dashed line 558.

FIG. 5*e* illustrates a further example of a programmable current mirror, again shown as a current sink. In this example implementation each column is provided with circuitry corresponding to that within dashed line 558 of FIG. 5*d*, that is with a current mirror output stage. One or more column selectors connects selected ones of these current mirror output stages to one or more respective programmable reference current supplies (source or sink), although in other arrangements it is preferable to provide a programmable reference current supply for each output stage. A further selector selects a column to be used as a reference input for the current mirror.

In the above-described column drivers column selection need not be employed if a separate current mirror output is provided for each column either of the complete display or for each column of a block of columns of the display.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of driving a passive matrix electroluminescent display, the display having a plurality of rows and columns of emissive elements addressed by respective row and column electrodes, the method comprising:

addressing said row electrodes, one at a time;

driving a set of said column electrodes while addressing each said row electrode;

converting drive level data for a set of said emissive elements into first data defining column drive current signal ratios of a drive current for a particular column electrode to an overall column drive current for said set of said column electrodes and second data defining an overall row drive current, wherein said column electrode driving comprises driving said set of said column electrodes at said column drive current signal ratios for said set of column electrodes; and driving each said addressed row at said overall row drive current to control a drive current to said emissive elements in each said addressed row, wherein said driving comprises driving said column electrodes with a current driver comprising a current mirror having a reference input and a plurality of outputs, and wherein said outputs are coupled to said column electrodes and one of said column electrodes is coupled to said reference input of said current mirror.

2. The method as claimed in claim 1, wherein said column electrode driving uses a plurality of first digital-to-analog converters (DACs) for determining said column drive signal ratios with either current sources or current sinks and a second digital-to-analog converter (DAC) for determining said overall row drive current with the other of a current source and a current sink, and wherein said second DAC has a higher resolution than said first DACs.

3. The method as claimed in claim 1 wherein said set of column electrodes comprises all said column electrodes of said display.

4. The method as claimed in claim 1 wherein said display comprises an OLED display and said emissive elements comprise OLEDs.

5. A driver for a passive matrix electroluminescent display, the display having a plurality of rows and columns of emissive elements addressed by respective rows and column electrodes, the driver comprising:

a column driver for driving a set of column electrodes in accordance with a set of column electrode drive ratios of a drive current for a particular column electrode to an overall drive current for said set of said column electrodes;

a row driver for selecting one of said row electrodes; and a system for controlling the overall drive current for said set of column electrodes, wherein said column driver and said row driver both comprise a current driver, and wherein said column driver comprises a current mirror having a reference input and a plurality of outputs, and means for selectively connecting said reference input to a said column electrode.

6. The driver as claimed in claim 5 wherein said system for controlling the overall drive current for said set of column electrodes comprises a system for driving said selected row electrode in accordance with an overall drive current for said set of column electrodes.

7. The driver as claimed in claim 5 wherein one of said column driver and said row driver comprises a controllable current source and the other a controllable current sink.

8. The driver as claimed in claim 5 wherein said column driver comprises a plurality of first digital-to-analog converters (DACs) for determining said column electrode drive ratios with either current sources or current sinks, and wherein said row driver comprises a second digital-to-analog converter (DAC) for determining said overall row electrode drive, said second DAC having a greater resolution than said first DACs.

9. The driver as claimed in claim 5 further comprising a data input for drive level data for said emissive elements, and a display drive processor to convert said drive level data to data for determining said column electrode drive ratios and said overall drive current for said column driver and said row driver respectively.

10. The driver as claimed in claim 5 wherein said display comprises an OLED display and said emissive elements comprise OLEDs.

* * * * *